US009632448B2

(12) United States Patent
Itagaki

(10) Patent No.: US 9,632,448 B2
(45) Date of Patent: Apr. 25, 2017

(54) IMAGE FORMING APPARATUS

(71) Applicant: CANON KABUSHIKI KAISHA, Tokyo (JP)

(72) Inventor: Tomohisa Itagaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/001,466

(22) Filed: Jan. 20, 2016

(65) Prior Publication Data

US 2016/0216636 A1 Jul. 28, 2016

(30) Foreign Application Priority Data

Jan. 23, 2015 (JP) ..... 2015-011757

(51) Int. Cl.
*G03G 15/04* (2006.01)
*G03G 15/00* (2006.01)

(52) U.S. Cl.
CPC . *G03G 15/04027* (2013.01); *G03G 15/04045* (2013.01); *G03G 15/5054* (2013.01); *G03G 2215/0129* (2013.01)

(58) Field of Classification Search
CPC ..... G03G 15/04027; G03G 15/5041; G03G 15/5058; G03G 2215/00037
See application file for complete search history.

(56) References Cited

U.S. PATENT DOCUMENTS

2007/0071471 A1 3/2007 Itagaki
2010/0290799 A1* 11/2010 Komiya ..... G03G 15/5033 399/49
2012/0201552 A1* 8/2012 Hirai ..... G03G 15/5058 399/49
2012/0315060 A1* 12/2012 Sugiyama ..... G03G 15/2039 399/69
2013/0243457 A1* 9/2013 Kaneko ..... G03G 15/5008 399/49

FOREIGN PATENT DOCUMENTS

JP 2003-228201 A 8/2003

* cited by examiner

*Primary Examiner* — David Gray
*Assistant Examiner* — Carla Therrien
(74) *Attorney, Agent, or Firm* — Fitzpatrick, Cella, Harper & Scinto

(57) ABSTRACT

An image forming apparatus includes a conversion unit configured to convert image data based on a conversion condition which corresponds to a type of halftone processing; an image processing unit configured to execute the halftone processing on the image data converted by the conversion unit, wherein the halftone processing includes first halftoning and second halftoning which is different from the first halftoning; and an image forming unit including a photoreceptor and an exposure unit configured to expose, based on the image data on which the halftone processing is executed by the image processing unit, the photoreceptor with light to form an electrostatic latent image on the photoreceptor.

12 Claims, 15 Drawing Sheets

| NUMBER OF SHEETS | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| LPW FOR INCREASING INTERVAL BETWEEN SHEETS | 50 | 50 | 50 | 50 | 50 | 50 | 50 | 50 | 50 | 50 | 55 | 55 | 55 | 55 | 55 | 55 | 55 | 55 |
| | REFLEC-TION | | | | | | | DETECT-ION | → | → | REFLEC-TION | | | | | | | DETECT-ION |
| NUMBER OF SHEETS | 19 | 20 | 21 | 22 | 23 | 24 | 25 | 26 | 27 | 28 | 29 | 30 | 31 | 32 | 33 | 34 | 35 | 36 |
| LPW FOR INCREASING INTERVAL BETWEEN SHEETS | 55 | 55 | 55 | 55 | 55 | 55 | 55 | 58 | 58 | 58 | 58 | 58 | 58 | 58 | 58 | 58 | 58 | 58 |
| | → | → | REFLEC-TION | | | | | | | DETECT-ION | → | → | REFLEC-TION | | | | | |
| NUMBER OF SHEETS | 37 | 38 | 39 | 40 | 41 | 42 | 43 | 44 | 45 | 46 | 47 | 48 | 49 | 50 | 51 | 52 | 53 | 54 |
| LPW FOR INCREASING INTERVAL BETWEEN SHEETS | 58 | 58 | 58 | 58 | 56 | 56 | 56 | 56 | 56 | 56 | 56 | 56 | 56 | 56 | 56 | 56 | 56 | 56 |
| | | DETECT-ION | → | → | REFLEC-TION | | | | | | | DETECT-ION | → | → | REFLEC-TION | | | |
| NUMBER OF SHEETS | 55 | 56 | 57 | 58 | 59 | 60 | 61 | 62 | 63 | 64 | 65 | 66 | 67 | 68 | 69 | 70 | 71 | 72 |
| LPW FOR INCREASING INTERVAL BETWEEN SHEETS | 56 | 57 | 57 | 57 | 57 | 57 | 57 | 57 | 57 | 57 | 57 | 57 | 57 | 57 | 57 | 57 | 56 | 56 |
| | | | | DETECT-ION | → | → | REFLEC-TION | | | | | | | DETECT-ION | → | → | REFLEC-TION | |

| DENSITY | SHEET NUMBER | NO CORRECTION | CONVENTIONAL CORRECTION | IMAGE FORMING APPARATUS 100 |
|---|---|---|---|---|
| | 1 | 1.500 | 1.500 | 1.500 |
| | 2 | 1.495 | 1.495 | 1.495 |
| | 3 | 1.490 | 1.490 | 1.490 |
| DETECTION | 4 | 1.485 | 1.485 | 1.485 |
| SECTION CHANGED AFTER DETECTION | 5 | 1.480 | 1.480 | 1.480 |
| REFLECTION | 6 | 1.475 | 1.475 | 1.475 |
| | 7 | 1.470 | 1.470 | 1.470 |
| | 8 | 1.465 | 1.465 | 1.465 |
| | 9 | 1.460 | 1.460 | 1.460 |
| | 10 | 1.455 | 1.455 | 1.455 |
| | 11 | 1.450 | 1.450 | 1.450 |
| | 12 | 1.445 | 1.465 | 1.490 |
| | 13 | 1.440 | 1.460 | 1.485 |
| | 14 | 1.435 | 1.455 | 1.480 |
| | 15 | 1.430 | 1.450 | 1.475 |
| | 16 | 1.425 | 1.445 | 1.470 |
| | 17 | 1.420 | 1.440 | 1.465 |
| | 18 | 1.415 | 1.435 | 1.460 |
| | 19 | 1.410 | 1.430 | 1.455 |
| | 20 | 1.405 | 1.425 | 1.450 |
| | 21 | 1.400 | 1.420 | 1.445 |
| | 22 | 1.395 | 1.465 | 1.490 |
| | 23 | 1.390 | 1.460 | 1.485 |
| | 24 | 1.385 | 1.455 | 1.480 |
| | 25 | 1.380 | 1.450 | 1.475 |
| | 26 | 1.375 | 1.445 | 1.470 |
| | 27 | 1.370 | 1.440 | 1.465 |
| | 28 | 1.365 | 1.435 | 1.460 |
| | 29 | 1.360 | 1.430 | 1.455 |
| | 30 | 1.355 | 1.425 | 1.450 |

FIG. 7A

| | | | |
|---|---|---|---|
| 31 | 1.350 | 1.420 | 1.445 |
| 32 | 1.345 | 1.465 | 1.490 |
| 33 | 1.340 | 1.460 | 1.485 |
| 34 | 1.335 | 1.455 | 1.480 |
| 35 | 1.330 | 1.450 | 1.475 |
| 36 | 1.325 | 1.445 | 1.470 |
| 37 | 1.320 | 1.440 | 1.465 |
| 38 | 1.315 | 1.435 | 1.460 |
| 39 | 1.310 | 1.430 | 1.455 |
| 40 | 1.305 | 1.425 | 1.450 |
| 41 | 1.300 | 1.420 | 1.445 |
| 42 | 1.295 | 1.465 | 1.490 |
| 43 | 1.290 | 1.460 | 1.485 |
| 44 | 1.285 | 1.455 | 1.480 |
| 45 | 1.280 | 1.450 | 1.475 |
| 46 | 1.275 | 1.445 | 1.470 |
| 47 | 1.270 | 1.440 | 1.465 |
| 48 | 1.265 | 1.435 | 1.460 |
| 49 | 1.260 | 1.430 | 1.455 |
| 50 | 1.255 | 1.425 | 1.450 |
| 51 | 1.250 | 1.420 | 1.445 |
| 52 | 1.245 | 1.465 | 1.490 |
| 53 | 1.240 | 1.460 | 1.485 |
| 54 | 1.235 | 1.455 | 1.480 |
| 55 | 1.230 | 1.450 | 1.475 |
| 56 | 1.225 | 1.445 | 1.470 |
| 57 | 1.220 | 1.440 | 1.465 |
| 58 | 1.215 | 1.435 | 1.460 |
| 59 | 1.210 | 1.430 | 1.455 |
| 60 | 1.205 | 1.425 | 1.450 |
| 61 | 1.200 | 1.420 | 1.445 |
| 62 | 1.195 | 1.465 | 1.490 |

FIG. 7B

| SUB-SCANNING PIXEL PERIOD | MAIN SCANNING PIXEL PERIOD | | | | | | | | | | | | | MAIN SCANNING FREQUENCY 2400 DPI | | | |
|---|---|---|---|---|---|---|---|---|---|---|---|---|---|---|---|---|---|
| | 0 | 1 | 2 | 3 | 4 | 5 | 6 | 7 | 8 | 9 | 10 | 11 | 12 | 13 | 14 | 15 | 16 |
| 0 | | 0.0° | 0.0° | 0.0° | 0.0° | 0.0° | 0.0° | 0.0° | 0.0° | 0.0° | 0.0° | 0.0° | 0.0° | 0.0° | 0.0° | 0.0° | 0.0° |
| | | 2400 | 1200 | 800 | 600 | 480 | 400 | 343 | 300 | 267 | 240 | 218 | 200 | 185 | 171 | 160 | 150 |
| 1 | 90.0° | 45.0° | 26.6° | 18.4° | 14.0° | 11.3° | 9.5° | 8.1° | 7.1° | 6.3° | 5.7° | 5.2° | 4.8° | 4.4° | 4.1° | 3.8° | 3.6° |
| | 2400 | 1697 | 1073 | 759 | 582 | 471 | 395 | 339 | 298 | 265 | 239 | 217 | 199 | 184 | 171 | 160 | 150 |
| 2 | 90.0° | 63.4° | 45.0° | 33.7° | 26.6° | 21.8° | 18.4° | 15.9° | 14.0° | 12.5° | 11.3° | 10.3° | 9.5° | 8.7° | 8.1° | 7.6° | 7.1° |
| | 1200 | 1073 | 849 | 666 | 537 | 446 | 379 | 330 | 291 | 260 | 235 | 215 | 197 | 182 | 170 | 159 | 149 |
| 3 | 90.0° | 71.6° | 56.3° | 45.0° | 36.9° | 31.0° | 26.6° | 23.2° | 20.6° | 18.4° | 16.7° | 15.3° | 14.0° | 13.0° | 12.1° | 11.3° | 10.6° |
| | 800 | 759 | 666 | 566 | 480 | 412 | 358 | 315 | 281 | 253 | 230 | 210 | 194 | 180 | 168 | 157 | 147 |
| 4 | 90.0° | 76.0° | 63.4° | 53.1° | 45.0° | 38.7° | 33.7° | 29.7° | 26.6° | 24.0° | 21.8° | 20.0° | 18.4° | 17.1° | 15.9° | 14.9° | 14.0° |
| | 600 | 582 | 537 | 480 | 424 | 375 | 333 | 298 | 268 | 244 | 223 | 205 | 190 | 176 | 165 | 155 | 146 |
| 5 | 90.0° | 78.7° | 68.2° | 59.0° | 51.3° | 45.0° | 39.8° | 35.5° | 32.0° | 29.1° | 26.6° | 24.4° | 22.6° | 21.0° | 19.7° | 18.4° | 17.4° |
| | 480 | 471 | 446 | 412 | 375 | 339 | 307 | 279 | 254 | 233 | 215 | 199 | 185 | 172 | 161 | 152 | 143 |
| 6 | 90.0° | 80.5° | 71.6° | 63.4° | 56.3° | 50.2° | 45.0° | 40.6° | 36.9° | 33.7° | 31.0° | 28.6° | 26.6° | 24.8° | 23.2° | 21.8° | 20.6° |
| | 400 | 395 | 379 | 358 | 333 | 307 | 283 | 260 | 240 | 222 | 206 | 192 | 179 | 168 | 158 | 149 | 140 |
| 7 | 90.0° | 81.9° | 74.1° | 66.8° | 60.3° | 54.5° | 49.4° | 45.0° | 41.2° | 37.9° | 35.0° | 32.5° | 30.3° | 28.3° | 26.6° | 25.0° | 23.6° |
| | 343 | 339 | 330 | 315 | 298 | 279 | 260 | 242 | 226 | 210 | 197 | 184 | 173 | 163 | 153 | 145 | 137 |
| 8 | 90.0° | 82.9° | 76.0° | 69.4° | 63.4° | 58.0° | 53.1° | 48.8° | 45.0° | 41.6° | 38.7° | 36.0° | 33.7° | 31.6° | 29.7° | 28.1° | 26.6° |
| | 300 | 298 | 291 | 281 | 268 | 254 | 240 | 226 | 212 | 199 | 187 | 176 | 166 | 157 | 149 | 141 | 134 |
| 9 | 90.0° | 83.7° | 77.5° | 71.6° | 66.0° | 60.9° | 56.3° | 52.1° | 48.4° | 45.0° | 42.0° | 39.3° | 36.9° | 34.7° | 32.7° | 31.0° | 29.4° |
| | 267 | 265 | 260 | 253 | 244 | 233 | 222 | 210 | 199 | 189 | 178 | 169 | 160 | 152 | 144 | 137 | 131 |
| 10 | 90.0° | 84.3° | 78.7° | 73.3° | 68.2° | 63.4° | 59.0° | 55.0° | 51.3° | 48.0° | 45.0° | 42.3° | 39.8° | 37.6° | 35.5° | 33.7° | 32.0° |
| | 240 | 239 | 235 | 230 | 223 | 215 | 206 | 197 | 187 | 178 | 170 | 161 | 154 | 146 | 139 | 133 | 127 |
| 11 | 90.0° | 84.8° | 79.7° | 74.7° | 70.0° | 65.6° | 61.4° | 57.5° | 54.0° | 50.7° | 47.7° | 45.0° | 42.5° | 40.2° | 38.2° | 36.3° | 34.5° |
| | 218 | 217 | 215 | 210 | 205 | 199 | 192 | 184 | 176 | 169 | 161 | 154 | 147 | 141 | 135 | 129 | 124 |
| 12 | 90.0° | 85.2° | 80.5° | 76.0° | 71.6° | 67.4° | 63.4° | 59.7° | 56.3° | 53.1° | 50.2° | 47.5° | 45.0° | 42.7° | 40.6° | 38.7° | 36.9° |
| | 200 | 199 | 197 | 194 | 190 | 185 | 179 | 173 | 166 | 160 | 154 | 147 | 141 | 136 | 130 | 125 | 120 |
| 13 | 90.0° | 85.6° | 81.3° | 77.0° | 72.9° | 69.0° | 65.2° | 61.7° | 58.4° | 55.3° | 52.4° | 49.8° | 47.3° | 45.0° | 42.9° | 40.9° | 39.1° |
| | 185 | 184 | 182 | 180 | 176 | 172 | 168 | 163 | 157 | 152 | 146 | 141 | 136 | 131 | 126 | 121 | 116 |
| 14 | 90.0° | 85.9° | 81.9° | 77.9° | 74.1° | 70.3° | 66.8° | 63.4° | 60.3° | 57.3° | 54.5° | 51.8° | 49.4° | 47.1° | 45.0° | 43.0° | 41.2° |
| | 171 | 171 | 170 | 168 | 165 | 161 | 158 | 153 | 149 | 144 | 139 | 135 | 130 | 126 | 121 | 117 | 113 |
| 15 | 90.0° | 86.2° | 82.4° | 78.7° | 75.1° | 71.6° | 68.2° | 65.0° | 61.9° | 59.0° | 56.3° | 53.7° | 51.3° | 49.1° | 47.0° | 45.0° | 43.2° |
| | 160 | 160 | 159 | 157 | 155 | 152 | 149 | 145 | 141 | 137 | 133 | 129 | 125 | 121 | 117 | 113 | 109 |
| 16 | 90.0° | 86.4° | 82.9° | 79.4° | 76.0° | 72.6° | 69.4° | 66.4° | 63.4° | 60.6° | 58.0° | 55.5° | 53.1° | 50.9° | 48.8° | 46.8° | 45.0° |
| | 150 | 150 | 149 | 147 | 146 | 143 | 140 | 137 | 134 | 131 | 127 | 124 | 120 | 116 | 113 | 109 | 106 |

FIRST PRIORITY

PRESENT DISCLOSURE APPLICABLE RANGE

FIG. 13

NORMAL IMAGE FORMING

| NUMBER OF SHEETS | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| LPW FOR FORMING NORMAL IMAGE | 50 | 50 | 50 | 50 | 50 | 50 | 50 | 50 | 50 | 50 | 50 | 50 | 50 | 50 | 50 | 50 | 50 | 50 |

CONVENTIONAL PATCH BETWEEN SHEETS

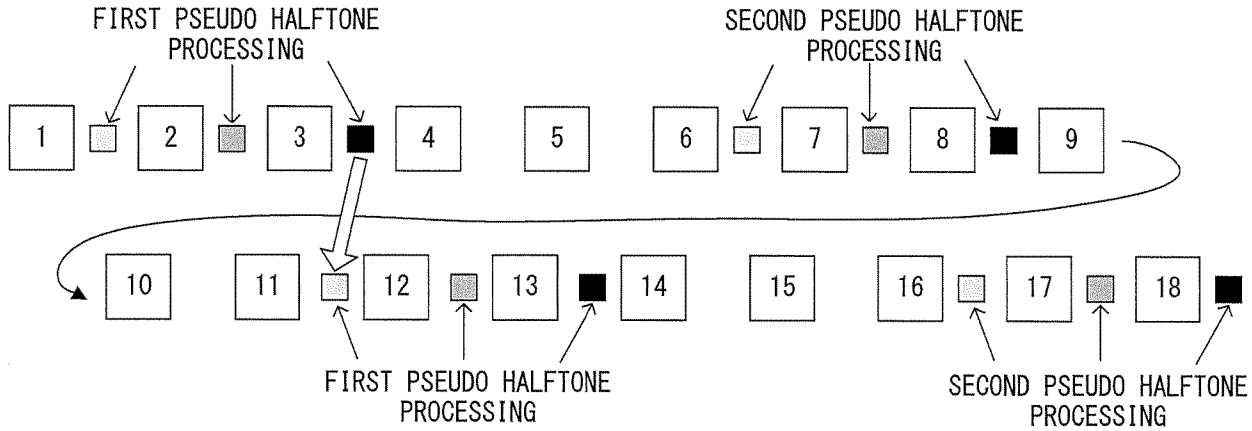

| NUMBER OF SHEETS | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| LPW FOR INCREASING INTERVAL BETWEEN SHEETS | 50 | 50 | 50 | 50 | 50 | 50 | 50 | 50 | 50 | 50 | 55 | 55 | 55 | 55 | 55 | 55 | 55 | 55 |
| | | | DETECT -ION | → | → | → | → | → | → | → | REFLEC -TION | | DETECT -ION | → | → | → | → | |
| NUMBER OF SHEETS | 19 | 20 | 21 | 22 | 23 | 24 | 25 | 26 | 27 | 28 | 29 | 30 | 31 | 32 | 33 | 34 | 35 | 36 |
| LPW FOR INCREASING INTERVAL BETWEEN SHEETS | 55 | 55 | 55 | 55 | 55 | 55 | 55 | 58 | 58 | 58 | 58 | 58 | 58 | 58 | 58 | 58 | 58 | 58 |
| | → | → | REFLEC -TION | | DETECT -ION | → | → | → | → | → | → | → | REFLEC -TION | | DETECT -ION | → | → | |
| NUMBER OF SHEETS | 37 | 38 | 39 | 40 | 41 | 42 | 43 | 44 | 45 | 46 | 47 | 48 | 49 | 50 | 51 | 52 | 53 | 54 |
| LPW FOR INCREASING INTERVAL BETWEEN SHEETS | 58 | 58 | 58 | 58 | 56 | 56 | 56 | 56 | 56 | 56 | 56 | 56 | 56 | 56 | 56 | 56 | 56 | 56 |
| | → | → | → | → | REFLEC -TION | | DETECT -ION | → | → | → | → | → | → | → | REFLEC -TION | | DETECT -ION | |
| NUMBER OF SHEETS | 55 | 56 | 57 | 58 | 59 | 60 | 61 | 62 | 63 | 64 | 65 | 66 | 67 | 68 | 69 | 70 | 71 | 72 |
| LPW FOR INCREASING INTERVAL BETWEEN SHEETS | 56 | 57 | 57 | 57 | 57 | 57 | 57 | 57 | 57 | 57 | 57 | 57 | 57 | 57 | 57 | 57 | 56 | 56 |
| | → | → | → | → | → | → | REFLEC -TION | | DETECT -ION | → | → | → | → | → | → | → | REFLEC -TION | |

FIG. 15

INCREASING INTERVAL PATCH BETWEEN SHEETS

| NUMBER OF SHEETS | 1 | 2 | 3 | 4 | | | 5 | 6 | 7 | 8 | | | 9 | 10 | 11 | 12 |
|---|---|---|---|---|---|---|---|---|---|---|---|---|---|---|---|---|
| LPW FOR INCREASING INTERVAL BETWEEN SHEETS | 50 | 50 | 50 | 50 | 50 | 50 | 50 | 50 | 50 | 50 | 55 | 55 | 55 | 55 | 55 | 55 |
| | | | | | DETECT-ION | | | | | | REFLEC-TION | | | | | |

IMAGE FORMING APPARATUS

BACKGROUND OF THE INVENTION

Field of the Invention

The present disclosure relates to an image forming apparatus.

Description of the Related Art

An electrophotographic image forming apparatus has a problem in terms of stability of image density (density variation) as compared with an inkjet image forming apparatus, an offset printing apparatus, etc. For example, there is a case where charge holding amount of toner changes during continuous output, resulting in changing developability and transferability of the toner. As a result, the image density changes.

For example, Japanese Patent Application Laid-open No. 2003-228201 discloses an image forming apparatus, in which a patch image for density correction is formed, the density of the image (toner density) is detected by a sensor, and image data which is being continuously output is changed based on the detection result. Also, in the apparatus, a gamma look-up table (gamma LUT) is used to control a development condition. The gamma look-up table is one-dimensional conversion table (gradation correction table) of the image data. It is a table for converting a signal value of the image data input to an output signal value for forming an image of an ideal gradation characteristic by the image forming apparatus. However, with the gamma LUT, it is not possible to increase the maximum density of the image formed by the image forming apparatus.

On the other hand, US Patent Application Publication No. 2007/071471 discloses an image forming apparatus which controls to form a latent image by changing an exposure condition and to increase the toner amount to be developed to correct maximum density. It is noted that when changing the exposure condition (laser power) for correcting the maximum density, halftone density changes accordingly. Thereby, when changing the exposure condition, it is necessary to check the halftone density under the exposure condition. Also, the gamma look-up table needs to be corrected.

FIG. 14 represents laser power when the image forming apparatus forms the image on A3 size sheet (18 sheets). As shown in FIG. 14, in the image forming apparatus, the exposure condition is not changed so that the laser power is maintained at 50. FIG. 15 shows a conventional example of correcting the laser power based on a measurement result of an image for measurement. The image for measurement is formed in an area between a plurality of sheets (an area between a preceding sheet and a following sheet). FIG. 16 also shows a conventional example of correcting the laser power based on the measurement result of the image for measurement. In FIG. 16, by increasing an interval where a plurality of sheets are conveyed, the area between a plurality of sheets is widened. Thereby, the image forming apparatus can form a plurality of images for measurement in one area. It is noted that, in FIGS. 15 and 16, the image forming apparatus can execute two types of halftone processing, i.e. first pseudo halftone processing and second pseudo halftone processing.

As shown in a table in FIG. 15, based on a detection result of the image for measurement formed between a 1st sheet and a 4th sheet, the image forming apparatus determines the exposure condition of the image for measurement which is formed between an 11th sheet and a 14th sheet. It means that, when forming the image for measurement which corresponds to the first pseudo halftone processing, the image forming apparatus in FIG. 15 updates the exposure condition based on the detection result of the image for measurement which corresponds to the first pseudo halftone processing which is previously performed. This is because it is required to form the image for measurement based on the exposure condition to which the maximum density is guaranteed. Otherwise, it is not possible to properly correct both the maximum density and the halftone density. Further, the image forming apparatus in FIG. 15 updates the exposure condition based on the detection result of the image for measurement which corresponds to the same halftone processing. This enables to obtain the exposure condition for guaranteeing the maximum density with high accuracy. However, there is a possibility that the image forming apparatus shown in FIG. 15 cannot follow the density variation caused in a short time. Also, as shown in a table in FIG. 16, the image forming apparatus stops the image formation on the sheet, which causes downtime. Thereby, it is desired to provide an image forming apparatus which can suppress the downtime while suppressing the density variation.

SUMMARY OF THE INVENTION

An image forming apparatus according to the present disclosure comprises: a conversion unit configured to convert image data based on a conversion condition which corresponds to a type of halftone processing; an image processing unit configured to execute the halftone processing to the image data converted by the conversion unit, wherein the halftone processing includes first halftoning and second halftoning which is different from the first halftoning; an image forming unit including a photoreceptor, an exposure unit configured to expose, based on the image data on which the halftone processing is executed by the image processing unit, the photoreceptor with light to form an electrostatic latent image on the photoreceptor, and a developing unit configured to develop the electrostatic latent image; an image carrier on which a measurement image is formed by the image forming unit; a measurement unit configured to measure the measurement image formed on the image carrier; a first generation unit configured to control the image forming unit to form a first measurement image which corresponds to the first halftoning, control the measurement unit to measure the first measurement image, and generate, based on the measurement result of the first measurement image by the measurement unit, a first conversion condition which corresponds to the first halftoning; a second generation unit configured to control the image forming unit to form a second measurement image which corresponds to the second halftoning after the first measurement image is formed, control the measurement unit to measure the second measurement image, and generate, based on the measurement result of the second measurement image by the measurement unit, a second conversion condition which corresponds to the second halftoning; and a determination unit configured to determine intensity of the light based on the measurement result of the first measurement image by the measurement unit during a time period between first timing and second timing, the first timing being a timing at which the image forming unit finished forming the first measurement image, and the second timing being a timing at which the image forming unit starts forming the second measurement image.

Further features of the present invention will become apparent from the following description of exemplary embodiments (with reference to the attached drawings).

BRIEF DESCRIPTION OF THE DRAWINGS

FIGS. 7A, 7B and 7C are tables illustrating a comparison between a conventional correction and a correction of the image forming apparatus according to the present embodiment.

FIG. 13 is a table for explaining contents of applicability/non-applicability table.

FIG. 15 is a diagram for explaining conventional patch image formation.

DESCRIPTION OF THE EMBODIMENTS

In the following, the present disclosure is described with reference to the accompanying drawings. It is noted that, in the following, a description is provided in a case where the present disclosure is applied to an electrophotographic laser beam printer, which is an example of the image forming apparatus. The present disclosure is also applicable to other image forming apparatus, such as inkjet printer, sublimation type printer, etc.

Figure 1:
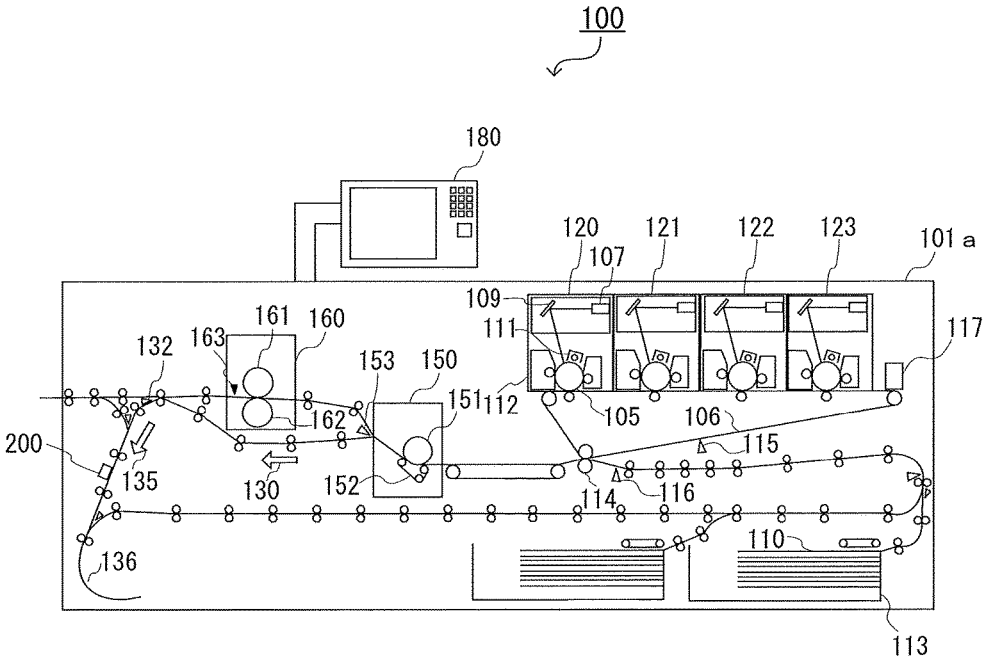
FIG. 1 is a schematic longitudinal cross-sectional view showing an example of configuration of an image forming apparatus.

FIG. 1 is a schematic longitudinal sectional view of an image forming apparatus. An image forming apparatus 100 comprises a housing body 101*a* and an operation panel 180. In the housing body 101*a*, various mechanisms which constitute an image forming unit adapted to form an image are arranged. In the image forming unit, laser light is scanned on a photosensitive drum 105 to form an electrostatic latent image. Then, the electrostatic latent image is developed. To perform multiple transfer of the developed image to an intermediate transfer body 106 to further transfer a color image having performed multiple transfer to a sheet 110, a transfer processing mechanism is arranged. Also, a fixing processing mechanism for fixing the toner image having transferred to the sheet 110, a sheet feeding processing mechanism for the sheet 110, a conveyance processing mechanism for the sheet 110, etc., are arranged.

The image forming apparatus 100 also comprises respective laser scanner units 107 which correspond to each color of yellow (Y), magenta (M), cyan (C) and black (K). The laser scanner unit 107 comprises a laser driver. In a case where the laser scanner unit 107 receives an image signal (image data), for example, whose image resolution is 2400 [dpi] from a controller 300 (described later), laser light is accordingly emitted from a semiconductor laser emitting device (not shown). The laser driver is used to drive ON/OFF of the laser light. The laser light emitted from the semiconductor laser emitting device is distributed in a scanning direction through a rotating polygon mirror (not shown). The laser light distributed in a main scanning direction is guided to the photosensitive drum 105 through a reflection mirror 109 and exposes a surface of the photosensitive drum 105.

On the other hand, the electrostatic latent image, which is formed on the photosensitive drum 105 by charging the photosensitive drum 105 by a charger 111 and by scanning exposure of the laser light, is developed into a toner image by toner supplied from a developing device 112 (described later). Then, the toner image developed on the photosensitive drum 105 is transferred onto the intermediate transfer body 106 to which a voltage of reverse characteristic to the toner image is applied (primary transfer). It is noted that, when forming the color image, respective colors are formed in order on the intermediate transfer body 106 from a yellow (Y) station 120, a magenta (M) station 121, a cyan (C) station 122, and a black (K) station 123. Thereby, a full color visible image is formed on the intermediate transfer body 106.

The full color visible image formed on the intermediate transfer body 106 is transferred to the sheet 110 fed from a storage 113. It is noted that, after the sheet 110 is fed from the storage 113, it is conveyed along a conveyance path. The sheet 110 conveyed along the conveyance path passes through a transfer nip part which lies between a transfer roller 114 and the intermediate transfer body 106. At this time, the sheet 110 is brought into pressure contact with the intermediate transfer body 106 by the transfer roller 114. Then, a voltage of reverse characteristic to the toner is applied to the transfer roller 114. Thereby, the image formed on the intermediate transfer body 106 is transferred to the sheet 110. It is noted that the photosensitive drum 105 and the developing device 112 are attachable/detachable to/from the image forming apparatus 100.

Also, a start position detection sensor 115 and a sheet feeding timing sensor 116 are arranged around the intermediate transfer body 106. The start position detection sensor 115 determines a print start position when performing image formation. The sheet feeding timing sensor 116 is used to control sheet feeding timing of the sheet 110. A density detection sensor 117 is also arranged. The density detection sensor 117 is used to measure the density of the patch image for density correction when controlling the density. It is noted that, based on the detection result of the density detection sensor 117, stabilization control (described later) is executed. Also, the detail of the density detection sensor 117 is described later.

The fixing processing mechanism comprises a first fixing unit 150 and a second fixing unit 160 for fixing the toner image transferred to the sheet 110 by heat and pressure. The first fixing unit 150 comprises a fixing roller 151 for applying heat to the sheet 110, a pressurizing belt 152 for bringing the sheet 110 into pressure contact with the fixing roller 151, and a post-fixing sensor 163 for detecting completion of fixation. Each roller is a hollow roller respectively having a heater inside and is configured to convey the sheet 110 at the same time each roller is rotationally driven. The second fixing unit 160 is positioned at a downstream side in the conveyance path of the sheet 110 as compared with the first fixing unit 150. The second fixing unit 160 glosses the toner image, and guarantees fixability to the toner image fixed on the sheet 110 by the first fixing unit 150. Similar to the first fixing unit 150, the second fixing unit 160 also comprises a fixing roller 161, a pressurizing roller 162, and a post-fixing sensor 163.

It is noted that, some sheets are not required to be conveyed through the second fixing unit 160 depending on a type of the sheet 110. In this case, to reduce energy consumption, the sheet 110 is guided to a conveyance path 130 through a conveyance path switching flapper 153 to discharge the sheet 110 without going through the second fixing unit 160.

The sheet 110 is guided to a conveyance path 135 through a conveyance path switching flapper 132. Then, a position of the sheet 110 is detected by a reverse sensor (not shown). After the detection of the sheet position, switchback operation is performed to the sheet 110 at a reverse section 136. Then, a preceding edge of the sheet 110 is changed. A color sensor 200 is a color sensor for detecting the patch image for density correction formed on the sheet 110. In a case where an instruction of color detection operation is given through the operation panel 180, density adjustment, gradation adjustment, multi-color adjustment, etc., are performed based on the detection result of the color sensor 200. It is noted that control with regard to the image forming processing by each mechanism (for example, sheet feeding processing) is performed through an image forming control unit 102 (described later).

[Operation Panel]

Figure 2:
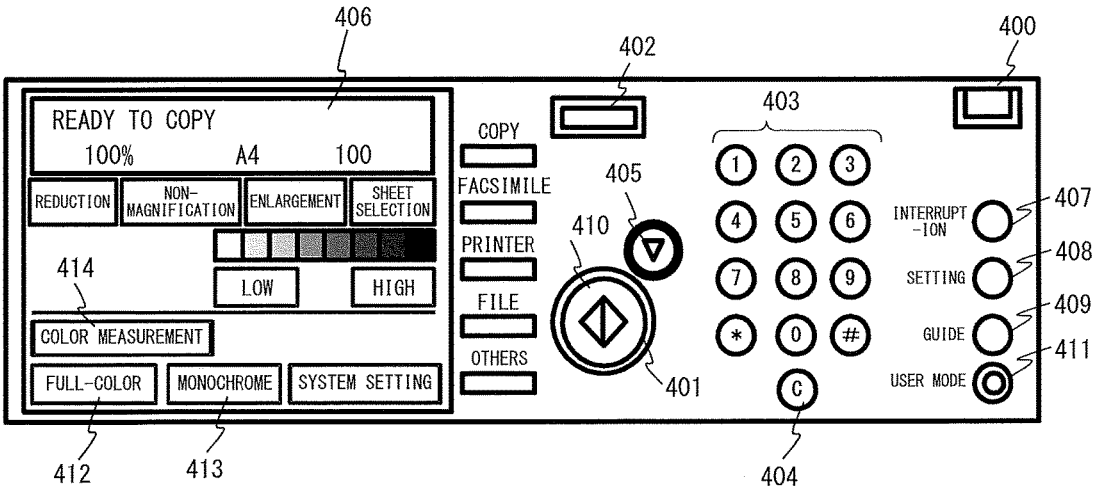
FIG. 2 is a partial enlarged view of a display screen of operation panel.

FIG. 2 is a partial enlarged view of a display screen of the operation panel 180. A soft switch 400 displayed on the display screen is a button for turning ON/OFF a power source of the image forming apparatus 100 main body. A copy start key 401 is a button for instructing to start copying. A reset key 402 is a button used to back an image forming mode of the image forming apparatus 100 to a normal mode. Here, it is supposed that the normal mode is a setting to form "full color: single side" image. Numeric keys 403 are keys used to input a numeric value such as the number of image forming sheets. A clear key 404 is a button used to clear the input numeric value. A stop key 405 is a button used to stop copying during continuous copying.

A touch panel 406 displays setting of various modes and a state of a printer. Also, it receives an input through touch operation. An interruption key 407 is a button used to interrupt during the continuous copying or while using the image forming apparatus 100 as a facsimile machine or a printer to execute other operations. A setting key 408 is a button used to manage the number of copies individually or sectionally. A guide key 409 is a button which is pressed down when using a guidance function.

A function key 410 is a key which is used when changing a function of the image forming apparatus 100. A user mode key 411 is a button used to switch to a mode which is managed and set by a user. In particular, the user mode key is used when the user adjusts sensitivity of the sensor, activates calibration mode of density and color, registers sheets, and changes setting time until the image forming apparatus 100 enters an energy saving mode. A color measuring mode 414 is a button used to switch the image forming apparatus 100 to a color measuring mode.

Also, a full color mode key 412 is a button selected when forming the full color image. A monochrome mode key 413 is a button selected when forming a monochrome image (or single color image). It is noted that a description is provided on an assumption that an instruction to select and execute a pseudo halftone processing pattern (hereinafter referred to as pseudo halftone processing) is given through, for example, the operation panel 180.

[Image Processing Unit]

Figure 3:
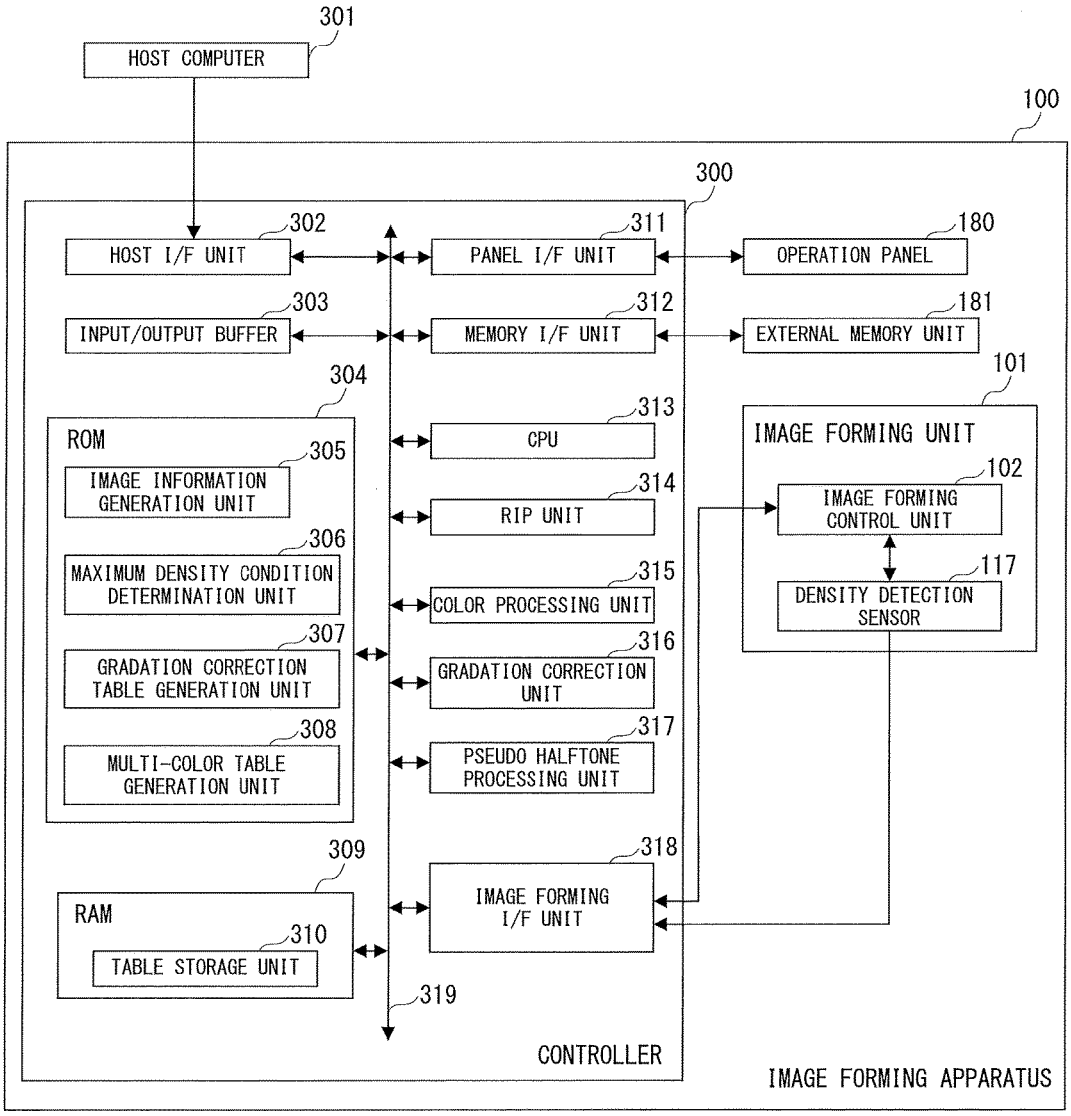
FIG. 3 is a block diagram for explaining an example of functional configuration of the image forming apparatus.

FIG. 3 is a block diagram for explaining an example of functional configuration of the image forming apparatus 100. The image forming apparatus shown in FIG. 3 is connected to a host computer 301 via a communication line such as a network (which is, for example, in compliance with 10base-T, IEEE 802.3). The controller 300 controls the operation of the image forming apparatus 100. Also, the controller 300 comprises a host I/F unit 302, an input/output buffer 303, a read only memory (ROM) 304, and an image information generation unit 305. The controller 300 also comprises a maximum density condition determination unit (Vcont: development contrast) 306, a gradation correction table generation unit (gamma LUT: gamma look up table) 307, and a multi-color table generation unit (ICC profile) 308. The controller 300 also comprises a random access memory (RAM) 309, a central processing unit (CPU) 313, a raster image processor (RIP) unit 314, a color processing unit 315, a gradation correction unit 316, a pseudo halftone processing unit 317, an image forming I/F unit 318, and a system bus 319.

The host I/F unit 302 mediates transmission and reception of information to and from the host computer 301. The input/output buffer 303 transmits and receives a control code from the host I/F unit 302 and data from each communication means. The CPU 313 controls the entire operation of the controller 300. A control program executed by the CPU 313 and various control data are stored in the ROM 304. The RAM 309 is used as a work memory for performing calculation required to translate the control code and data, or required to print. It is also used as a work memory for processing print data. The image information generation unit 305 generates various image objects based on the data received from the host computer 301.

The RIP unit 314 develops the image object into a bitmap image. The color processing unit 315 performs multi-color color conversion processing (described later). The gradation correction unit 316 converts a signal value of the image data for each color component to a type of the halftone processing based on the corresponding gamma LUT. The pseudo halftone processing unit 317 executes the pseudo halftone processing, which is referred to as dither matrixes, error diffusion method, etc., to the image data converted by the gradation correction unit 316. The image forming I/F unit 318 transfers the converted image to the image forming unit 101. The image is formed in the above mentioned manner. It is noted that a flow of the image processing is shown by a thick solid line in the drawing. Also, in the image forming apparatus 100, at least two types of the pseudo halftone processing pattern can be executed. In each of a plurality of the pseudo halftone processing, the image forming apparatus 100 forms the patch image for density correction. Then, based on the patch image, the image forming apparatus 100 optimizes the maximum density condition and the gradation correction table.

The maximum density determination unit 306 determines the maximum density correction condition to adjust the maximum density. It is noted that the maximum density correction condition means, for example, the intensity of light from the laser scanner unit 107, the charging bias when the charger 111 charges the photosensitive drum 105, and the developing bias which is applied to the developing device 112 for developing the electrostatic latent image. To correct the density characteristic (gradation characteristic) of the image formed by the stations 120, 121, 122, and 123 to the ideal density characteristic (gradation characteristic), the gradation correction table generation unit 307 generates the gamma LUT which converts the signal value of the image data. To correct the variation of the multi-color, the multi-color table generation unit 308 generates ICC profile which is multi-dimension LUT. It is noted that the adjustment result of the maximum density condition determination unit 306, the gradation correction table generation unit 307, and the multi-color table generation unit 308 respectively are stored in the table storage unit 310 in the RAM 309.

A panel I/F unit 311 mediates transmission and reception of information between the controller 300 and the operation panel 180. A memory I/F unit 312 mediates transmission and reception of information between the controller 300 and an external memory unit 181 which is used to store print data, information of various print devices, etc. It is noted that the image information generation unit 305, the maximum density condition determination unit 306, the gradation correction table generation unit 307, and the multi-color table generation unit 308 in which the correction result of the multi-color is reflected are stored in the ROM 304 as a function module.

Also, information of the ICC profile, the gamma LUT, and the Vcont used at the time of the image formation is appropriately managed and updated. It is noted that the feature of the present disclosure, i.e., change of the exposure condition in the interval between the sheets, is determined by the maximum density condition determination unit 306 as mentioned. Then, the determination result is notified to the image forming control unit 102. The exposure condition is changed (reflected) before printing the patch image in the first pseudo halftone processing (described later).

[Outline of Density Detection Sensor and Stabilization Control]

Figure 4:
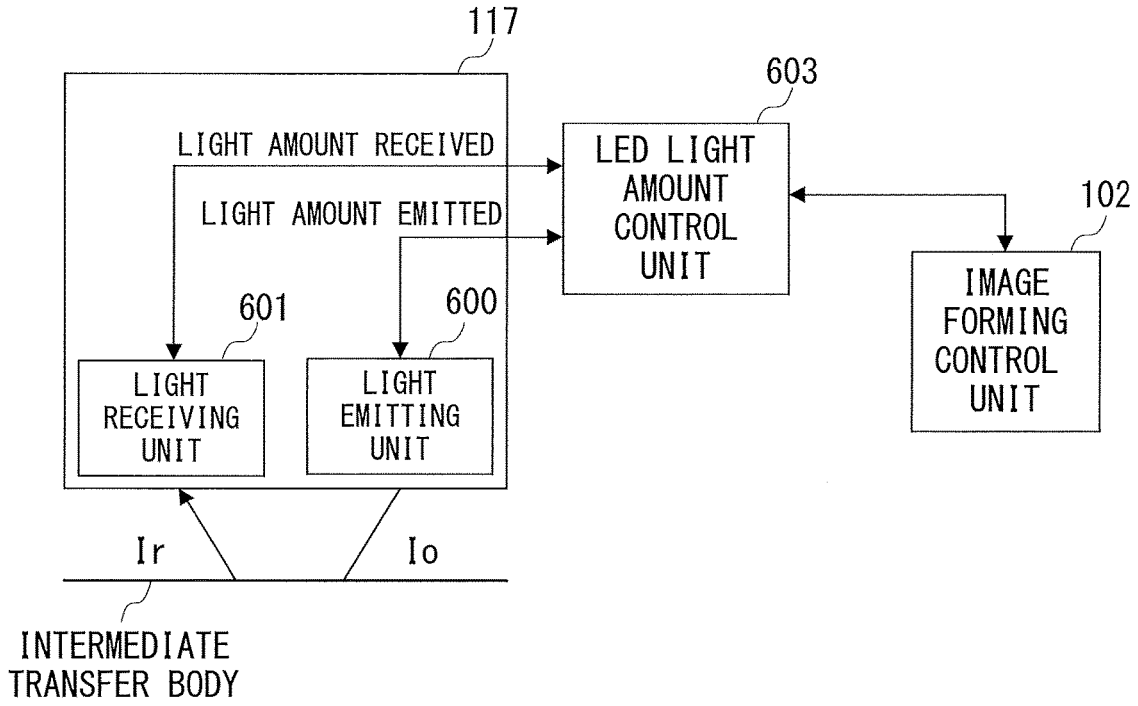
FIG. 4 is a diagram for explaining stabilization control in the image forming apparatus.

FIG. 4 is a diagram for explaining stabilization control in the image forming apparatus 100. The density detection sensor 117 comprises a light emitting unit 600 and a light receiving unit 601. Light Io emitted from the light emitting unit 600 is reflected on the surface of the intermediate transfer body. Then, the reflected light Ir is measured at the light receiving unit 601. The reflected light Ir measured at the light receiving unit 601 is monitored at an LED light amount control unit 603. The monitored result is then sent to the image forming control unit 102. The image forming control unit 102 calculates the density based on the light source light Io and the measured value of the reflected light Ir.

The density detection sensor 117 is used for the stabilization control for obtaining correct color tone in a recorded image. It means that the density detection sensor 117 detects the patch image formed on the intermediate transfer body. It is noted that the stabilization control includes, for example, "Dmax control" and "halftone control". In the Dmax control, the maximum density condition determination unit 306 causes the stations 120, 121, 122, and 123 to form the patch image. Then, the maximum density condition determination unit 306 causes the density detection sensor 117 to measure the patch image formed on the intermediate transfer body 106. Then, based on the measurement result, the maximum density condition determination unit 306 determines the exposure amount which corresponds to target maximum density.

Also, in the halftone control, the gradation correction table generation unit 307 controls the exposure amount of the laser scanner unit 107 based on the exposure amount determined in the Dmax control to form a plurality of patch images. At this time, the gradation correction table generation unit 307 causes the pseudo halftone processing unit 317 to execute the halftone processing to the image data for measurement. Then, the gradation correction table generation unit 307 causes the stations 120, 121, 122, and 123 to form a plurality of patch images on the intermediate transfer body based on the image data for measurement having the halftone processing performed thereto. The gradation correction table generation unit 307 causes the density detection sensor 117 to measure the patch image. Then, the gradation table generation unit 307 generates the gamma LUT based on the measured result of the patch image such that the density characteristic (also referred gradation characteristic) of the image to be formed by the stations 120, 121, 122, and 123 reaches target density characteristic. The gamma LUT is stored in the gradation correction unit 316 to wait for the next image formation. It is noted that, in the stabilization control, while the image forming apparatus 100 is continuously forming a plurality of images, the patch image having the halftone processing performed thereto is formed in an interval between the sheets (an area between the sheets). The patch image is then detected by the density detection sensor 117. A detailed description of this feature is provided in the following.

[Stabilization Control During Sheet Feeding]

Figure 5:
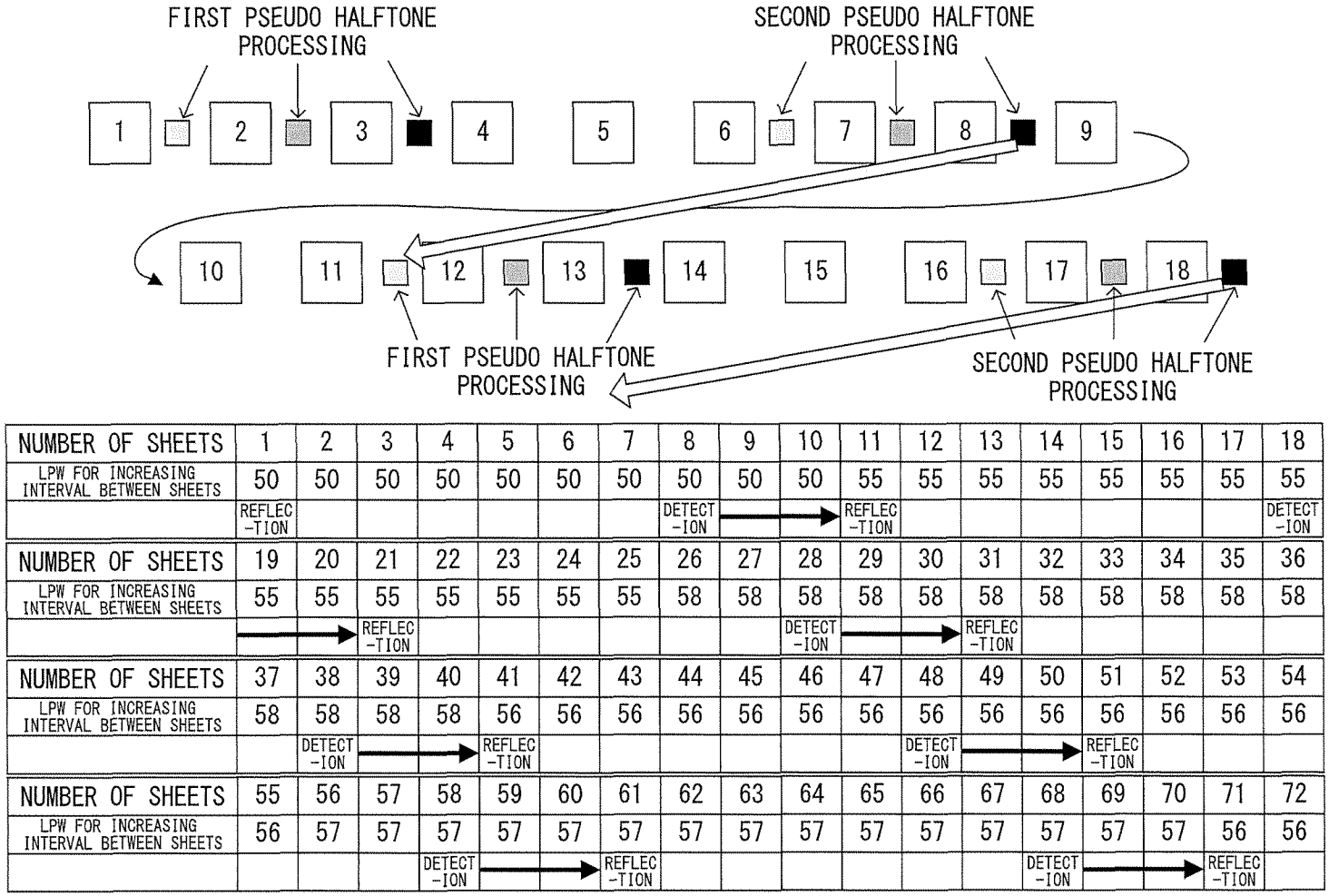
FIG. 5 is a diagram for explaining patch image to be printed by the image forming apparatus in an interval between sheets.

FIG. 5 is a diagram for explaining a patch image to be formed in an interval between the sheets by the image forming apparatus 100. FIG. 5 represents a schematic diagram of a patch image formed on the intermediate transfer body 106 while the image forming apparatus 100 is continuously forming the image on A3 size sheets (18 sheets). FIG. 5 also shows a table indicating a change of the laser power when forming the image and the patch image. The patch image with different density is printed in an interval between the specified sheets. The patch images with different density (thickness) having the first pseudo halftone processing performed thereto are respectively printed in the interval between a 1st sheet and a 2nd sheet, in the interval between the 2nd sheet and a 3rd sheet, and in the interval between the 3rd sheet and a fourth sheet, which are continuously conveyed. Also, the patch images with different density having a second pseudo halftone processing performed thereto are respectively printed in the interval between a 6th sheet and a 7th sheet, in the interval between the 7th sheet and an 8th sheet, and in the interval between the 8th sheet and a 9th sheet.

It is noted that a signal value of the image data for measurement when forming these six patch images are previously determined. Then, based on the detection result of the patch image having respective pseudo halftone processing performed thereto, the gamma LUT which corresponds to the type of the halftone processing is generated. It means that, based on the measured result of the patch images formed in the interval between the 1st sheet and the 4th sheet, the gradation correction table generation unit 307 generates the gamma LUT which corresponds to the first pseudo halftone processing. Likewise, based on the measured result of the patch images formed in the interval between the 6th sheet and the 9th sheet, the gradation correction table generation unit 307 generates the gamma LUT which corresponds to the second pseudo halftone processing. It is noted that the gradation correction table generation unit 307 generates the gamma LUT which corresponds to the first pseudo halftone processing based on the patch images formed in the interval between the 11th sheet and a 14th sheet. Likewise, the gradation correction table generation unit 307 generates the gamma LUT which corresponds to the second pseudo halftone processing based on the patch images formed in the interval between a 16th sheet and a 19th sheet.

Figure 6:
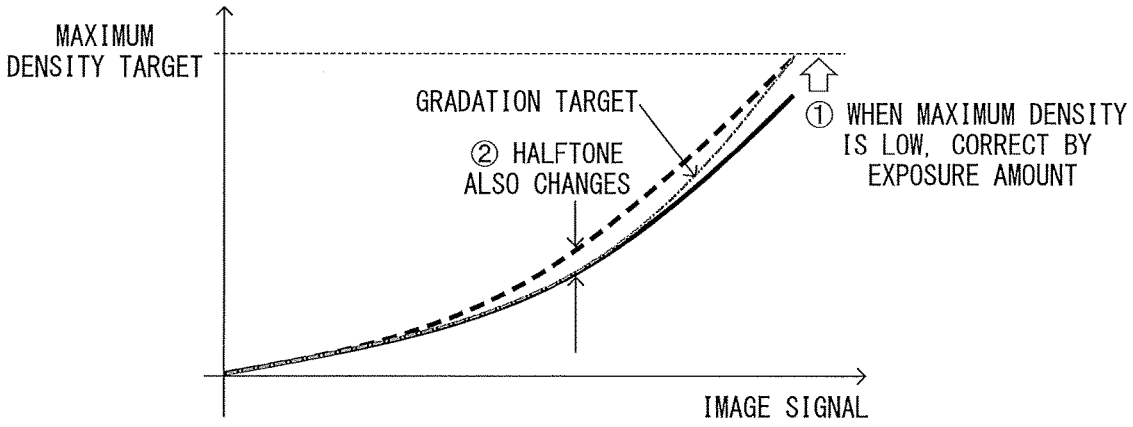
FIG. 6 is a diagram for explaining relation between maximum density and development contrast.

Here, the gamma LUT can only correct the density within a range of "0 to 255". Thereby, it is not possible to obtain the printed density which is equal to or higher than "255". Therefore, as shown by a graph in FIG. 6, in which relation between the maximum density and the development contrast is indicated, when it is determined that the maximum density is low, it is required to change the development contrast (Vcont). In this case, by changing the exposure amount, the development contrast is changed. It is noted that the exposure amount may be scanning time of one pixel such as PWM. Also, when the exposure amount is changed, the density of the halftone is accordingly changed. Thereby, it is required to print the patch image in accordance with the change of the exposure amount to correct the halftone. In the following, the exposure amount is referred to as LPW (laser power).

For example, in a conventional method as shown in FIG. 15, a state of the maximum density is figured out based on the patch image with high density (high density part) formed in the first pseudo halftone processing in the interval between the 3rd sheet and the 4th sheet. Then, based on the first patch image formed in the same first pseudo halftone processing in the interval between the 11th sheet and the 12th sheet, the LPW is changed. It means that, in a time period from first timing, at which the image forming apparatus 100 finished forming the patch image in the interval between the 8th sheet and the 9th sheet, to second timing, at which the image forming apparatus starts to form the patch image in the interval between the 11th sheet and the 12th sheet, the LPW is changed based on the measurement result which corresponds to the patch image formed in the interval between the 8th sheet and the 9th sheet. Also, in the table shown in FIG. 15, the change of the maximum density detected in the interval between the 3rd sheet and the 4th sheet is reflected to the print of the patch image formed in the interval between the 11th sheet and the 12th sheet. This causes delay for eight sheets from the detection to the reflection. Thereby, when correcting the density change in the conventional manner, there is a problem in its followability.

On the other hand, as shown in FIG. 5, the image forming apparatus 100 reflects the measurement result of the patch image formed in the interval between the 8th sheet and the 9th sheet to the LPW adopted when forming the patch image in the interval between the 11th sheet and the 12th sheet. Thereby, the delay is compressed to three sheets. It means that, while simultaneously changing the exposure condition and the gamma LUT in the first pseudo halftone processing, the followability of the correction relating to the maximum density variation can also be improved. A description of this feature is provided with FIGS. 7A-7C.

Figure 7C:
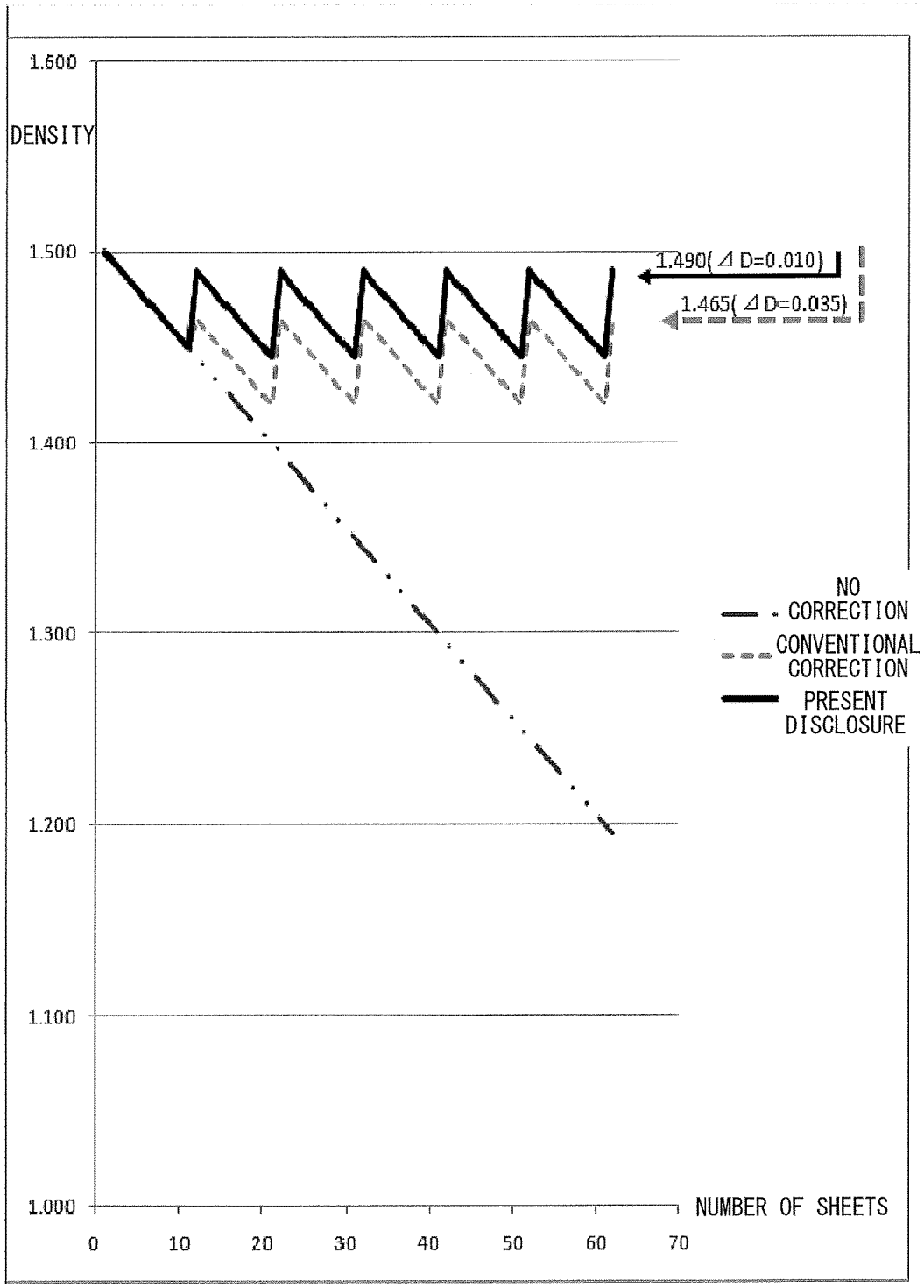

FIGS. 7A-7C comprise a table in which conventional correction is compared with the correction of the present disclosure. In a case where density variation per one sheet from a 1st to a 62nd sheet maintains −0.005, if no correction is performed, the density decreases from 1.500 to 1.195. As shown in FIGS. 7A-7C, if the decrease is compensated by the conventional correction, the density decreases from 1.500 to 1.465, and the difference therebetween is 0.035. On the contrary, in the image forming apparatus 100 of the present disclosure, the density changes from 1.500 to 1.490, and the difference therebetween is 0.010. Thereby, decrease in the amount of the density can be reduced. The same effect can be ensured in the final correction of a 61st sheet in FIGS. 7A-7C (see Table 1 and Table 2 as below).

TABLE 1

| Density Immediately before correction | No correction | Conventional correction | Present disclosure |
|---|---|---|---|
| $1^{st}$ sheet | 1.500 | 1.500 | 1.500 |
| $61^{st}$ sheet | 1.200 | 1.420 | 1.455 |
| Density difference between $1^{st}$ and $61^{st}$ sheets | 0.300 | 0.080 | 0.045 |

TABLE 2

| Density Immediately after correction | No correction | Conventional correction | Present disclosure |
|---|---|---|---|
| $1^{st}$ sheet | 1.500 | 1.500 | 1.500 |
| $62^{nd}$ sheet | 1.195 | 1.465 | 1.490 |
| Density difference between $1^{st}$ and $62^{nd}$ sheets | 0.305 | 0.035 | 0.010 |

In the conventional correction, it spent a lot of time from the detection of the density to the reflection, during which the decrease of the density has reached 0.035 (1.485−1.450). The decrease of the density cannot be corrected. Even if it is immediately after the correction (reflection) by the exposure, the density is 1.465, meaning that the density difference of 0.035 caused in the eight sections cannot be corrected. On the other hand, with the image forming apparatus 100, it is three sections from the detection of the density to the reflection, which is short. Thereby, the density variation therebetween is 0.01. It means that, as compared with the density difference 0.035 of the conventional correction, it is largely improved.

[Correction of Exposure Amount]

Figure 8:
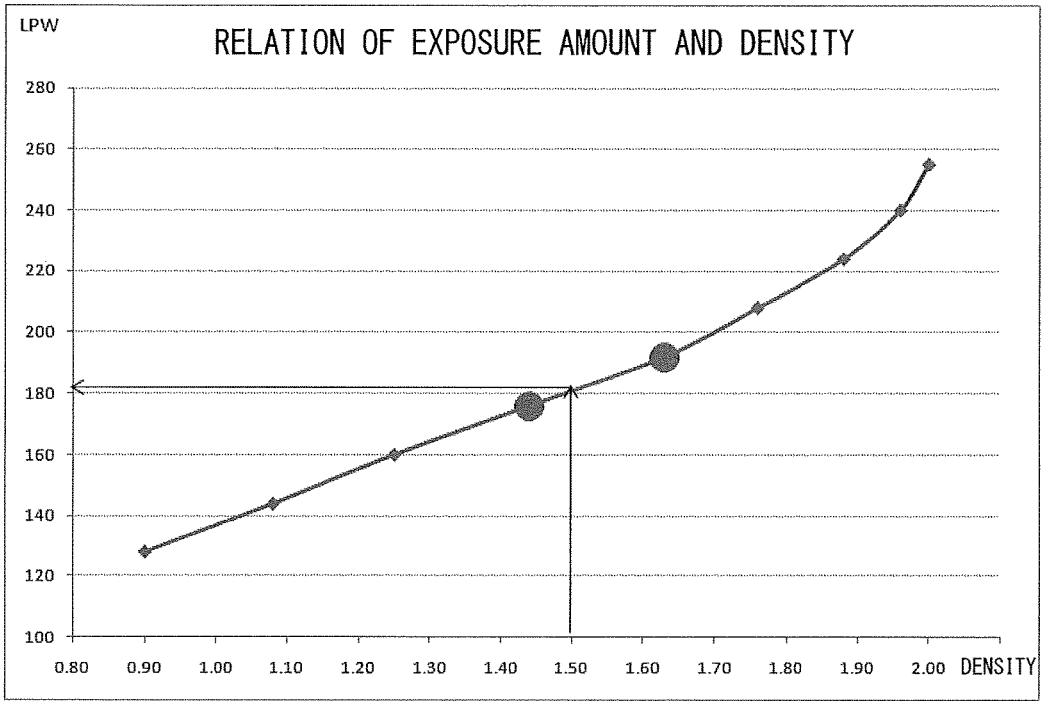
FIG. 8 is a graph showing the relation of exposure amount and density.
Figure 9:
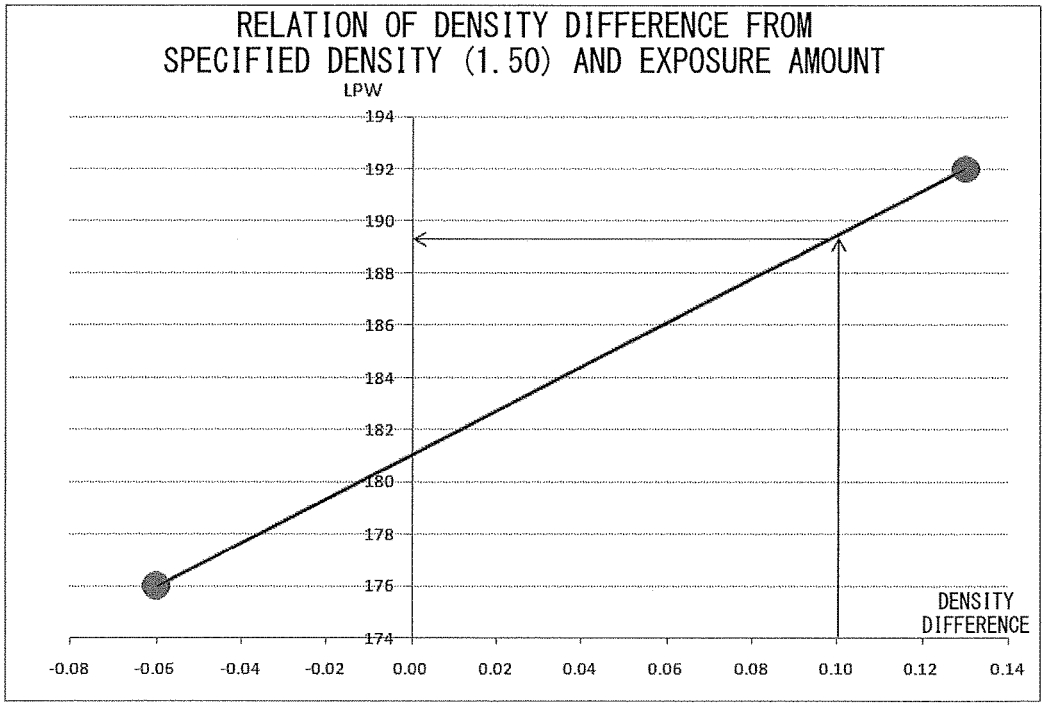
FIG. 9 is a graph showing relation of density difference from specified density and exposure amount.

FIG. 8 is a graph showing relation of the exposure amount and the density. FIG. 9 is a graph showing relation of density difference from specified density and the exposure amount. In the Dmax control, LPW=181 is derived. This is LPW for realizing the specified density of 1.50. The relation of the density and the exposure amount obtained at this time is used to control the interval between the sheets. Also, as a method to correct the exposure amount knowing the decrease of the density, following methods (A, B) can be adopted.

A. Execution of Dmax Control

Execute the Dmax control when turning on a power or started up by a user, through which the exposure condition is changed and the density is figured out to thereby find out the exposure condition which achieves the desired density (please see FIG. 8). The Dmax control may be executed based on the detection results of the color sensor 200 or the density detection sensor 117.

B. Computation in the Interval Between Sheets

According to the relation of the exposure amount and the density obtained through the Dmax control, the specified density is deducted to derive the relation shown in FIG. 9. That is, if it is desired to realize the predetermined density with an increase of the density by 0.01 from the specified density, what is required is to simply set the specified exposure amount to derive LPW=189. It is noted that, in FIG. 9, linear interpolation between the sections interposing the specified density is given as an example. However, a curve approximation using multipoint may also be adopted.

[Halftone Processing]

The image forming apparatus 100 determines the correction amount of the development contrast condition based on the detection result of the second pseudo halftone processing. Then, with the correction amount, the image forming apparatus 100 forms the patch image in the first pseudo halftone processing. This is one of the features of the image forming apparatus 100. To establish the relation, the gradation characteristic in a vicinity of the high density part needs to have a similar shape in the first pseudo halftone processing and the second pseudo halftone processing. A description of this feature is provided in the following.

Figure 10:
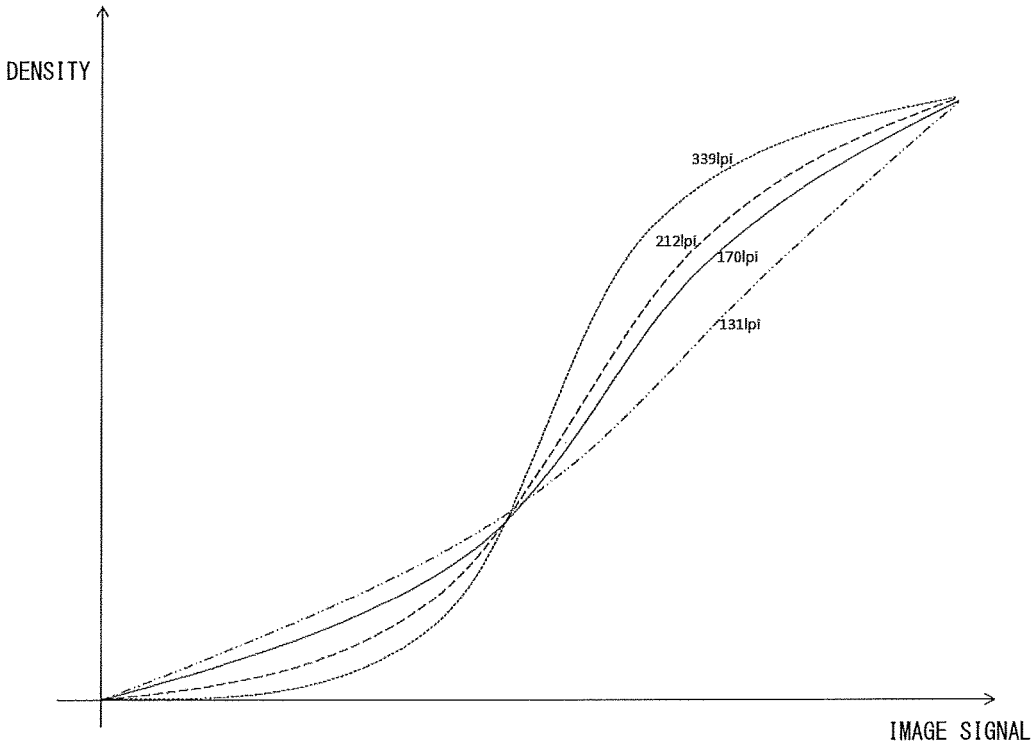
FIG. 10 is a graph for explaining gradation characteristic.
Figure 11:
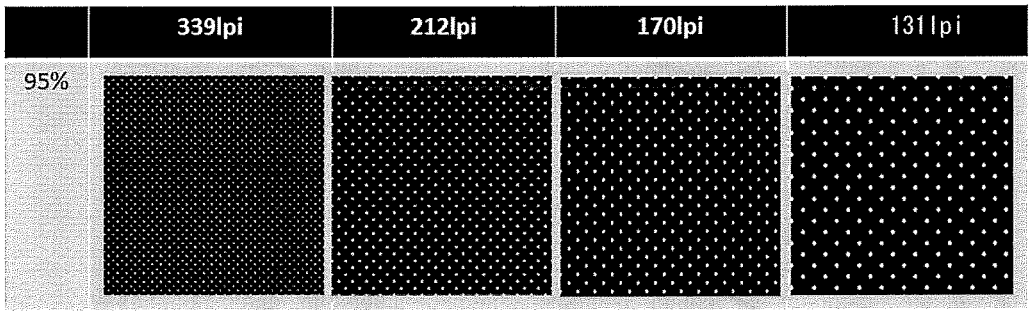
FIG. 11 is a schematic diagram for explaining gradation characteristic.

FIG. 10 and FIG. 11 are diagrams for explaining gradation characteristic whose number of lines is 131 [lpi: line per inch], 170 [lpi], 212 [lpi], and 339 [lpi]. As shown in FIG. 11, when comparing the low number of lines, 131 [lpi], with the high number of lines, 339 [lpi], the size of "white dot" remaining in white in the low number of lines, 131 [lpi], is large. In the electrophotographic system, there may be a case where "collapse" in the latent image, "scattering" when developing, transferring, etc., or "crush" when fixing is caused. In such a case, there is a high tendency that, due to gamma characteristic, an S-shape is drawn, which is caused by toner dot gain which is similar to mechanical dot gain and optical dot gain in an offset printing. The optical dot gain is caused by being covered with color material. Also, the higher the number of the lines is, the closer it gets to the S-shape electrophotographic characteristic curve, instead of the gradation of digital expression. Also, in the low number of lines, gradation close to the digital expression (downward projecting arc shape) is obtained.

As mentioned, even in the high density part, if the number of the lines largely differs, the gradation characteristic changes. Thereby, to perform high density part correction with other pseudo halftone processing, there was a problem in terms of accuracy. Inventors of the present application determined that it is possible to predict the variation of the high density part even with the other pseudo halftone processing by determining its application range as follows. A description will be provided with regard to determination flows of A to D with reference to a table 3 shown below.

A. Obtain maximum density condition (development contrast condition) by which density is increased by 0.10 from specified solid (255) density.

In the image forming apparatus 100, the LPW is, for example, Ref+5[%].

B. Calculate density increase ratio of the condition A (when changing specified maximum density condition) of a part where the density is 95[%] (area ratio 95[%]) in the first pseudo halftone processing.

The image forming apparatus 100 is, for example, 105.6 [%].

C. Calculate density increase ratio of the condition A (when changing specified maximum density condition) of a part where the density is 95[%] (area ratio 95[%]) in each of the second pseudo halftone processing candidates.

D. In the second pseudo halftone processing, difference between the calculation result of the condition B and the calculation result of the condition C is within ±1[%].

TABLE 3

| Number: Density | Description | 130 lpi | 170 lpi | 212 lpi | 339 lpi |
|---|---|---|---|---|---|
| | | First pseudo halftone processing | | | |
| Image Signal 95% | Condition Ref solid density +0.10 (LPW +5%) | 1.49 (Ref Ratio 104.2%) | 1.53 (Ref Ratio 105.6%*) | 1.54 (Ref Ratio 106.2%) | 1.58 (Ref Ratio 106.8%) |
| | Ref Second pseudo halftone processing determination (difference with * ±1%) | 1.42 failed (difference with * 1.4%) | 1.44 — | 1.45 passed (difference with * 0.6%) | 1.48 failed (difference with * 1.2%) |

As long as the pseudo halftone processing which satisfies the conditions A to D, the characteristic of the high density part is similar to the first pseudo halftone processing. So, the variation of the high density part in the first pseudo halftone processing can be substituted by the other pseudo halftone processing. In this case, when the first and the second pseudo halftone processing patterns have the area ratio equal to or more than 95[%] and have the same area ratio, the first and the second pseudo halftone processing patterns will have relation in which the difference of the density increase ratio when changing the specified maximum density condition is within ±1[%] formed in the first and the second pseudo halftone processing patterns. Also, when the first and the second pseudo halftone processing patterns have the area ratio equal to or more than 95[%] and have the same area ratio, the first and the second pseudo halftone processing patterns will have relation in which the difference of the density increase ratio when increasing the specified exposure amount which realizes the predetermined density is less than or equal to 1[%].

Figure 12:
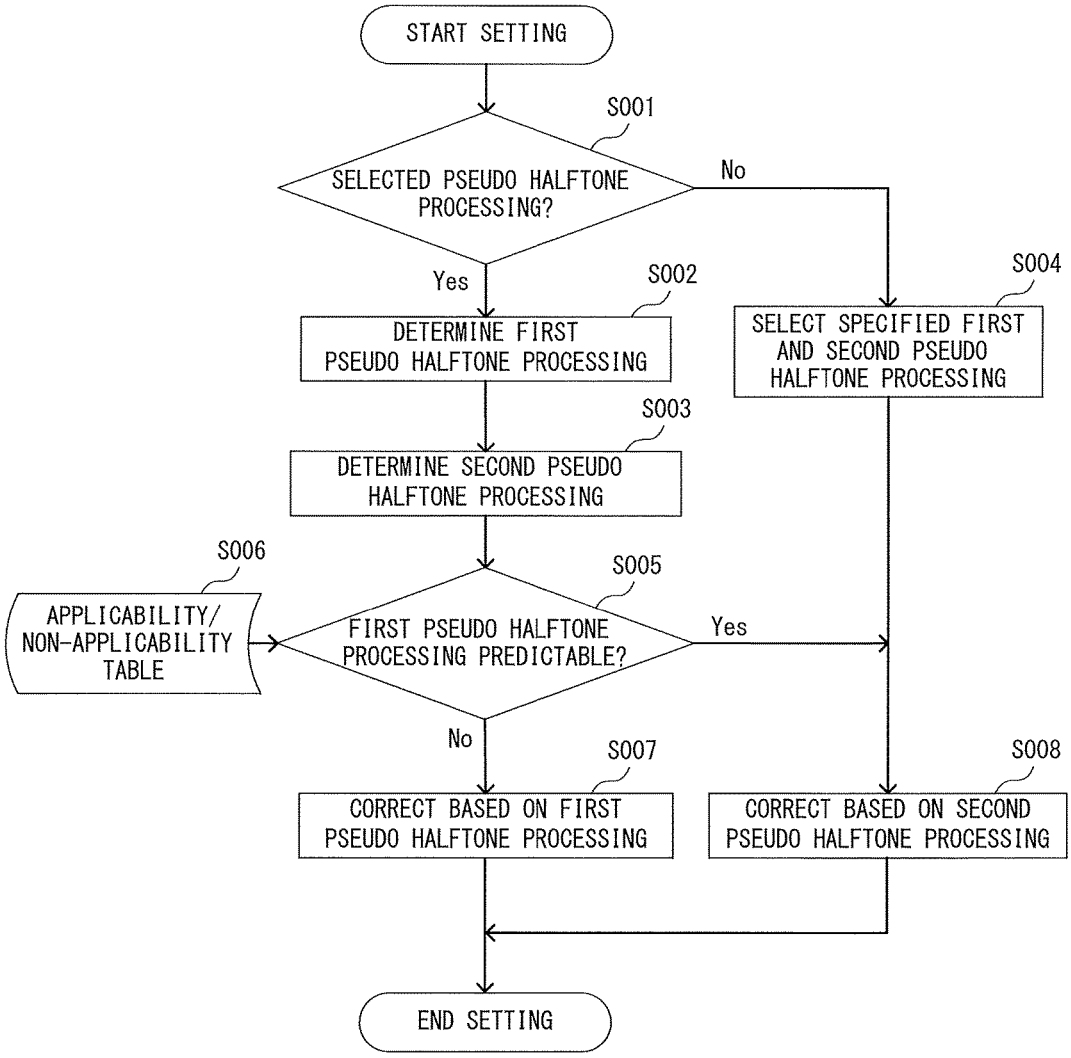
FIG. 12 is a flowchart illustrating an example of processing procedure of the image forming apparatus.
Figure 14:
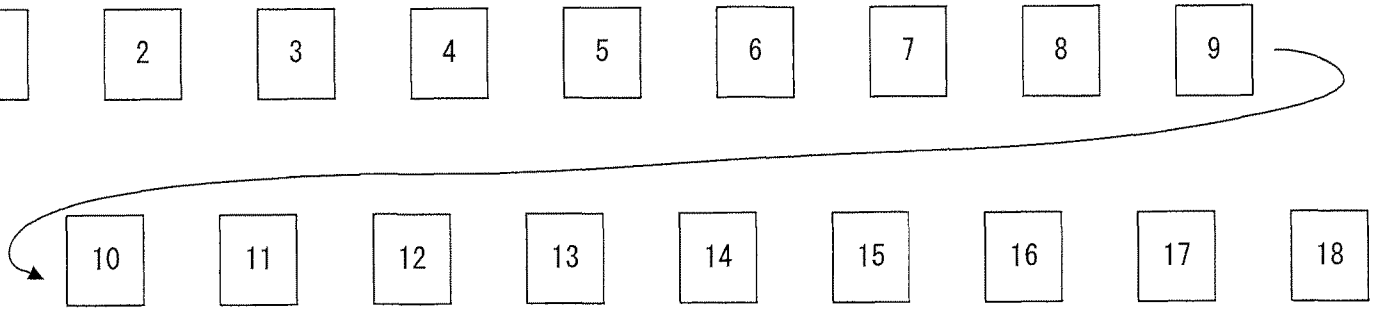
FIG. 14 is a diagram for explaining flow of general image formation.
Figure 16:
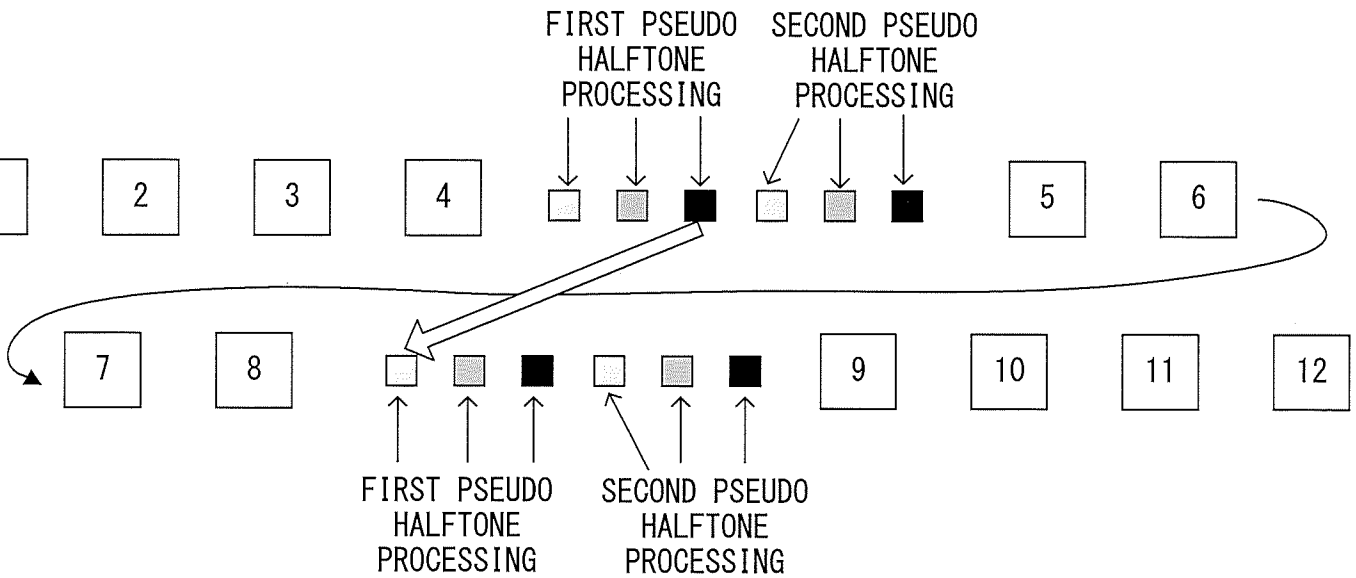
FIG. 16 is a diagram for explaining increasing interval between sheets in the conventional patch image formation.

Here, a description is provided with regard to the image forming apparatus 100, in which the user can optionally select the specified first and second pseudo halftone processing, in addition to selecting, by the user, the specified first and second pseudo halftone processing, using FIGS. 12 and 13. Texture of the image formed by the image forming apparatus changes depending on the contents of the pseudo halftone processing to be performed. Thereby, depending on user's preference, compatibility with the image data, the image forming apparatus can be configured as the image forming apparatus which can optionally be selected from a plurality of the pseudo halftone processing.

FIG. 12 is a flowchart illustrating an example of the processing procedure of the image forming apparatus 100. The CPU 313 determines whether the user selected the pseudo halftone processing through the operation panel 180 (S001). If it is determined that the user selected the pseudo halftone processing (S001: Y), the CPU 313 determines the pseudo halftone processing selected by the user as the first pseudo halftone processing (S002). Here, the first pseudo halftone processing (second halftoning) is applied to image data having pixel information whose attribute information is "Image" and image data whose attribute information is graphics. In particular, the Image information includes a person's photograph, so that the stability of the image should most be emphasized. It is noted that the RIP unit 314 determines the attribution.

The CPU 313 determines the pseudo halftone processing selected by the user as the second pseudo halftone processing (S003). Here, it is general that, the second pseudo halftone processing (first halftoning) is for the image data having the image information whose attribution is text, and the pseudo halftone processing with high number of lines is adopted. This is to prevent jaggies from being caused, i.e., prevent a situation in which the image data is recognized as a character. It is noted that the RIP unit 314 determines the attribution. It is noted that if the pseudo halftone processing is not selected by the user (S001: N), the CPU 313 selects the specified first and second pseudo halftone processing (S004).

The CPU 313 determines whether the variation of the high density part in the first pseudo halftone processing is predictable through the second pseudo halftone processing selected by the user (S005). It is noted that this is determined with reference to an applicability/non-applicability table in which whether the variation of the high density part shown in FIG. 13 is predictable or not is previously specified. FIG. 13 is a table for explaining the contents of the applicability/non-applicability table. In FIG. 13, the first pseudo halftone processing is, for example, the number of the lines, 170 [lpi], 45.0[° ] (part shaded in black). In this case, those matching with the applicability determination flows A to D as mentioned are shown as gray hatching parts. In a case where the gray hatching parts are selected as the second pseudo halftone processing, i.e., if it is determined that the variation of the high density part is predictable (S005: Y), the CPU 313 calculates an LPW correction coefficient based on the variation of the high density part detected in the second pseudo halftone processing. Then, the CPU 313 executes the density control through the second pseudo halftone processing (S008).

If it is determined that the variation of the high density part is not predictable (S005: N), the CPU 313 calculates the LPW correction coefficient based on the variation of the high density part detected in the conventional first pseudo halftone processing and executes the density control (S007). It is noted that FIG. 13 represents the applicability/non-applicability table when the number of the lines, 170[lpi], is selected as an example. The contents are previously determined for every number of lines which is selectable.

As mentioned, the image forming apparatus 100 detects the variation of the high density part of the patch image in the second pseudo halftone processing and determines the maximum density correction condition to the high density part before printing the patch image in the first pseudo halftone processing. Then, based on the maximum density correction condition determined, the image forming apparatus 100 forms the patch image in the first pseudo halftone processing. Then, in accordance with the detection result based on the patch image, the image forming apparatus 100 generates the gamma LUT. Thereby, it is possible to suppress the reduction of the maximum density without changing frequency of the reflection as explained using the tables 1 and 2. Further, it is possible to improve productivity while suppressing the density variation. Thus, in accordance with the present disclosure, it is possible to provide the image forming apparatus which can improve productivity while suppressing the density variation.

It is noted that, in the description as above, the LPW adopted when forming the patch image of the first pseudo halftone processing based on the measurement result of the patch image in the second pseudo halftone processing is only updated. It means that the CPU 313 functions as a prohibition unit which prohibits the LPW from being updated based on the measurement result of the patch image of the first pseudo halftone processing. This is to suppress a situation in which the density of the images continuously formed varies by frequently changing the LPW. Also, the LPW adopted when forming the patch image in the interval between the 6th sheet and the 7th sheet based on the measurement result of the patch image formed in the interval between the 3rd sheet and the 4th sheet may be updated. It means that, the LPW after the timing at which the patch image of the first pseudo halftone processing is formed based on the measurement result of the patch image of the second pseudo halftone processing may be updated. Likewise, the LPW after the timing at which the patch image of the second pseudo halftone processing is formed based on the measurement result of the patch image of the first pseudo halftone processing may be updated.

[Variation]

Descriptions have been provided in the above in case of monochromatic correction. Alternatively, it is needless to say that it is applicable in forming the patch image in full color image. It is also possible to configure such that CMYK is detected in the interval between a plurality of sheets by a main scanning 1 sensor. It is also possible to configure such that CMYK is detected in the interval between the sheets of the same sheets by a main scanning sensor 4. Also, in the description as above, the description has been provided with regard to the variation of 95[%] area which is not solid patch. Not limited to this, as long as the solid density is predictable, any number may be used as a lower threshold for the variation of the area. Also, even in a case where an input signal is a value of 255 (input value), which turns an output value of 255 after passing the gamma LUT, no problem will be caused. Thereby, the present disclosure is applicable from shadow patch to the solid patch. Also, it is needless to say that the present disclosure is applicable in types of machines which the patch image as a pattern.

The above embodiments are only the examples to specifically explain the present invention. Therefore, the scope of the invention is not limited to these embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-011757, filed Jan. 23, 2015, which is hereby incorporated by reference herein in its entirety.

What is claimed is:

1. An image forming apparatus comprising:

a conversion unit configured to convert image data based on a conversion condition which corresponds to a type of halftone processing;

an image processing unit configured to execute the halftone processing on the image data converted by the conversion unit, wherein the halftone processing includes first halftoning and second halftoning which is different from the first halftoning;

an image forming unit including a photoreceptor, an exposure unit configured to expose, based on the image data on which the halftone processing is executed by the image processing unit, the photoreceptor with light to form an electrostatic latent image on the photoreceptor, and a developing unit configured to develop the electrostatic latent image;

an image carrier on which a measurement image is formed by the image forming unit;

a measurement unit configured to measure the measurement image formed on the image carrier;

a first generation unit configured to control the image forming unit to form a first measurement image which corresponds to the first halftoning, control the measurement unit to measure the first measurement image, and generate, based on the measurement result of the first measurement image by the measurement unit, a first conversion condition which corresponds to the first halftoning;

a second generation unit configured to control the image forming unit to form a second measurement image which corresponds to the second halftoning after the first measurement image is formed, control the measurement unit to measure the second measurement image, and generate, based on the measurement result of the second measurement image by the measurement unit, a second conversion condition which corresponds to the second halftoning; and a determination unit configured to determine intensity of the light based on the measurement result of the first measurement image by the measurement unit during a time period between first timing and second timing, the first timing being a timing at which the image forming unit finished forming the first measurement image, and the second timing being a timing at which the image forming unit starts forming the second measurement image, wherein, in a case where the first measurement image and the second measurement image have an area ratio equal to or more than 95% and have the same area ratio, a difference of a density increase ratio between the first measurement image and the second measurement image is within ±1%.

2. The image forming apparatus according to claim 1, wherein the number of screen lines to be used in the first halftoning is greater than the number of screen lines to be used in the second halftoning.

3. The image forming apparatus according to claim 1, wherein the image processing unit is further configured to execute the second halftoning in a case where a type of the image data is graphics.

4. The image forming apparatus according to claim 1, wherein the image processing unit is further configured to execute the first halftoning in a case where a type of the image data is text.

5. The image forming apparatus according to claim 1, further comprising a prohibition unit configured to prohibit the intensity of light from being controlled by the measurement unit based on the measurement result of the second measurement image.

6. An image forming apparatus comprising:

a conversion unit configured to convert image data based on a conversion condition which corresponds to a type of halftone processing;

an image processing unit configured to execute the halftone processing on the image data converted by the conversion unit, wherein the halftone processing includes first halftoning and second halftoning which is different from the first halftoning;

an image forming unit including a photoreceptor, an exposure unit configured to expose, based on the image data on which the halftone processing is executed by the image processing unit, the photoreceptor with light to form an electrostatic latent image on the photoreceptor, and a developing unit configured to develop the electrostatic latent image;

an image carrier on which a measurement image is formed by the image forming unit;

a measurement unit configured to measure the measurement image formed on the image carrier;

a controller configured to:

control the image forming unit to form a predetermined measurement image and a first measurement image;

control the measurement unit to measure the predetermined measurement image and the first measurement image;

control the image forming unit to form a second measurement image; and control the measurement unit to measure the second measurement image;

an adjustment unit for adjusting, before forming the second measurement image, the intensity of the light of the exposure unit based on the measurement result of the predetermined measurement image; and a generation unit configured to generate a first conversion condition corresponding to the first halftoning based on the measurement result of the first measurement image and to generate a second conversion condition corresponding to the second halftoning based on the measurement result of the second measurement image, wherein the predetermined measurement image and the first measurement image are formed based on first measurement image data on which the image processing unit executes the first halftoning, wherein the second measurement image is formed based on second measurement image data on which the image processing unit executes the second halftoning, wherein the conversion unit, in a case where the image processing unit executes the first halftoning on the image data, converts the image data based on the first conversion condition, and wherein the conversion unit, in a case where the image processing unit executes the second halftoning on the image data, converts the image data based on the second conversion condition.

7. The image forming apparatus according to claim 6, wherein the controller controls the image forming unit to form another predetermined measurement image and another first measurement image after forming the second measurement image, and controls the measurement unit to measure the other measurement image and the other first measurement image, and wherein the generation unit generates the first conversion condition based on the measurement result of the other first measurement image.

8. The image forming apparatus according to claim 6, wherein the adjustment unit, in a case where a combination of a type of a halftone processing corresponding to the first halftoning and a type of a halftone processing corresponding to the second halftoning is a predetermined combination, inhibits adjusting the intensity of the light of the exposure unit based on the measurement result of the predetermined measurement image before forming the second measurement image.

9. The image forming apparatus according to claim 8, wherein the adjustment unit, in a case where a combination of the type of halftone processing corresponding to the first halftoning and the type of halftone processing corresponding to the second halftoning is the predetermined combination, adjusts the intensity of the light of the exposure unit based on the measurement result of the predetermined measurement image after forming the second measurement image.

10. The image forming apparatus according to claim 6, wherein the number of screen lines to be used in the first halftoning is greater than the number of screen lines to be used in the second halftoning.

11. The image forming apparatus according to claim 6, wherein the image processing unit is further configured to execute the second halftoning in a case where a type of the image data is graphics.

12. The image forming apparatus according to claim 6, wherein the image processing unit is further configured to execute the first halftoning in a case where a type of the image data is text.

* * * * *